US008475216B2

(12) United States Patent
Tung et al.

(10) Patent No.: US 8,475,216 B2
(45) Date of Patent: Jul. 2, 2013

(54) ELECTRICAL CONNECTOR HAVING MATING INTERFACE CONFIGURED BY COMPOSITE TONGUE MEMBER

(75) Inventors: Chang-Hsien Tung, Tu-Cheng (TW); Kuo-Chun Hsu, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 265 days.

(21) Appl. No.: 12/983,827

(22) Filed: Jan. 3, 2011

(65) Prior Publication Data

US 2011/0159747 A1 Jun. 30, 2011

(51) Int. Cl.
*H01R 24/00* (2011.01)

(52) U.S. Cl.
USPC ..... 439/660; 439/607.4

(58) Field of Classification Search
USPC ..... 439/660, 607.4
See application file for complete search history.

(56) References Cited

U.S. PATENT DOCUMENTS 5,344,327 A * 9/1994 Brunker et al. ..... 439/108
6,039,611 A * 3/2000 Yang ..... 439/701
6,619,968 B2 * 9/2003 Xu ..... 439/79
6,672,905 B2 * 1/2004 Tharp et al. ..... 439/660
6,736,676 B2 * 5/2004 Zhang et al. ..... 439/607.22
7,591,683 B2 * 9/2009 Zhang et al. ..... 439/638
7,748,999 B1 * 7/2010 Sun et al. ..... 439/79
7,811,110 B2 * 10/2010 He et al. ..... 439/218
7,811,131 B2 10/2010 Wang et al.
7,845,982 B1 * 12/2010 Wang ..... 439/607.25
7,883,372 B1 * 2/2011 Sun et al. ..... 439/607.55
8,007,323 B1 * 8/2011 Yao et al. ..... 439/660
8,021,188 B1 * 9/2011 Ma et al. ..... 439/607.55
8,052,471 B1 * 11/2011 Xiong et al. ..... 439/607.01
8,123,558 B2 * 2/2012 Su et al. ..... 439/607.01
8,157,599 B2 * 4/2012 Wei ..... 439/660
8,198,563 B2 * 6/2012 Tsai ..... 218/140
2011/0059656 A1 * 3/2011 Tsai ..... 439/660
2011/0159747 A1 * 6/2011 Tung et al. ..... 439/660
2012/0071032 A1 * 3/2012 Tsai ..... 439/660
2012/0077390 A1 * 3/2012 Tsai ..... 439/660
2012/0302076 A1 * 11/2012 Tsai ..... 439/131

* cited by examiner

*Primary Examiner* — Neil Abrams
(74) *Attorney, Agent, or Firm* — Wei Te Chung; Ming Chieh Chang

(57) ABSTRACT

An electrical connector includes an insulative housing defining a receiving cavity thereof, a tongue member retained to the receiving cavity, and a shell surrounding the housing. The tongue member includes first and second tongue modules interlocked with each other, the first tongue module retains a plurality of first contacts thereof and the second tongue module retains a plurality of second contacts thereof. The first tongue module defines a retaining slot at a front portion thereof and a blocking plate surrounding the retaining slot, the second tongue module defines at least one retaining portion received in the retaining slot and supported by the blocking plate.

20 Claims, 6 Drawing Sheets

ELECTRICAL CONNECTOR HAVING MATING INTERFACE CONFIGURED BY COMPOSITE TONGUE MEMBER

BACKGROUND OF THE INVENTION

1. Field of the Invention

The present invention relates to an electrical connector, and more particularly to an electrical connector having a mating interface configured by upper and lower tongue modules facilitating cost-effective manufacturing and assembling.

2. Description of the Related Art

A conventional electrical connector for highly data transmission rates such as disclosed in U.S. Pat. No. 7,811,131 issued to Wang et al. on Oct. 12, 2010, defines an insulative housing and two contact modules received in the housing. The housing defines a base portion and a tongue portion extending forward from the base portion, and the contact modules each defines a main portion and a plurality of contacting portions forwardly projecting beyond the main portion. During assemblage, the contact modules are assembled to the housing with the contacting portions inserted into the corresponding receiving grooves arranged on the tongue portion and exposed upon the opposite surfaces of the tongue portion.

However, the contacting portions should be aligned with the corresponding receiving grooves accurately, furthermore, in recent years, the pitch of the connector become smaller and smaller, i.e. each electrical connectors is provided with more and more contacts for meeting highly data transmission rates requirement and the large numbers of contacts are hardly to be aligned with the corresponding receiving grooves while assemblage.

Therefore, an improved electrical connector with simple assemblage and steady configuration is highly desired.

SUMMARY OF THE INVENTION

An object of the present invention is to provide an electrical connector with improved tongue member for simple assemblage and secure configuration.

In order to achieve the above-mentioned object, an electrical connector includes an insulative housing defining a receiving cavity thereof, a tongue member retained to the receiving cavity, and a shell surrounding the housing. The tongue member includes first and second tongue modules interlocked with each other, the first tongue module retains a plurality of first contacts thereof and the second tongue module retains a plurality of second contacts thereof. The first tongue module defines a retaining slot at a front portion thereof and a blocking plate surrounding the retaining slot, the second tongue module defines at least one retaining portion received in the retaining slot and supported by the blocking plate.

Other objects, advantages and novel features of the invention will become more apparent from the following detailed description of the present embodiment when taken in conjunction with the accompanying drawings.

DETAILED DESCRIPTION OF THE INVENTION

Figure 1:
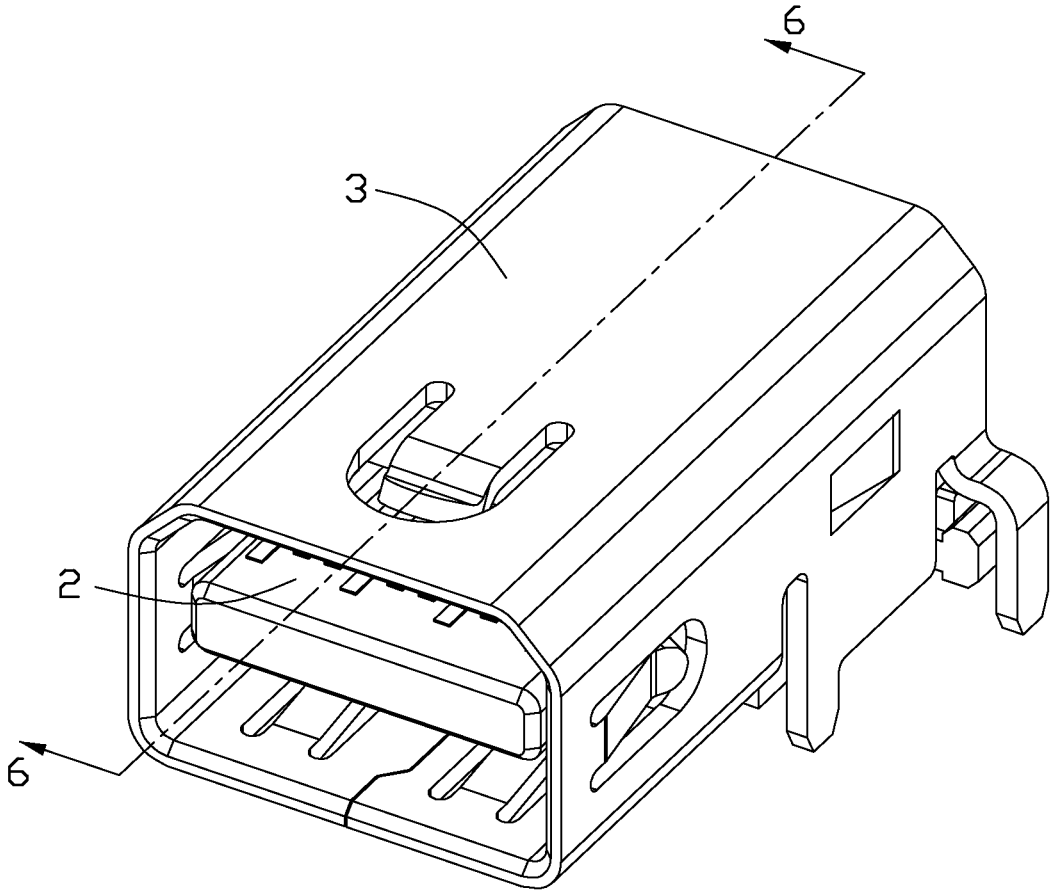
FIG. 1 is an assembled, perspective view of an electrical connector in accordance with the present invention.

Reference will now be made to the drawing figures to describe the preferred embodiments of the present invention in detail.

Figure 2:
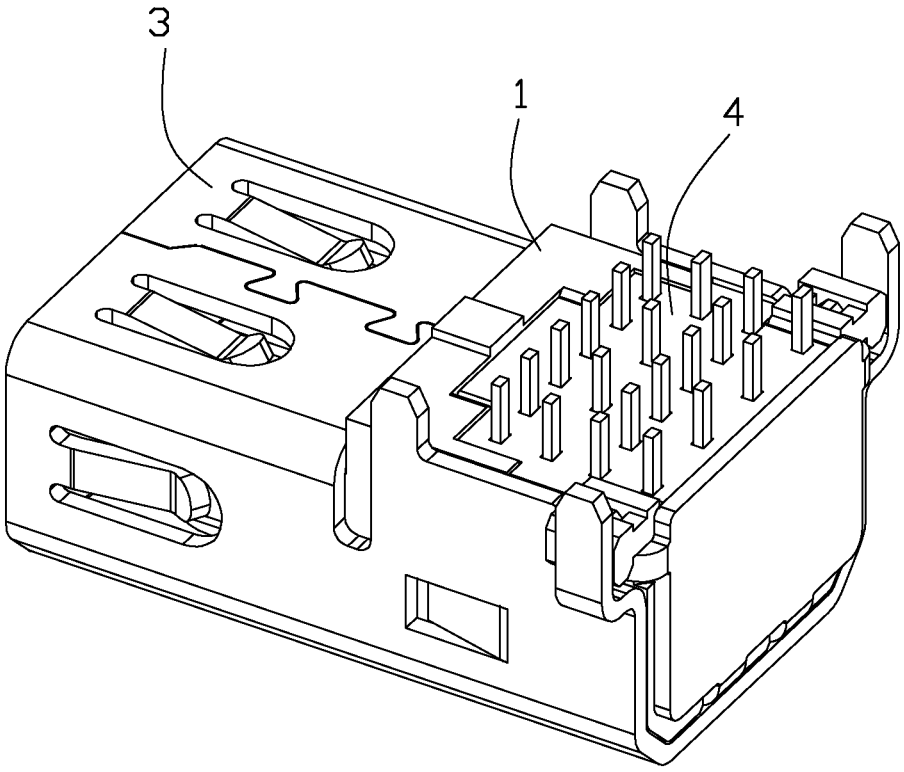
FIG. 2 is another assembled, perspective view of the electrical connector shown in FIG. 1.

Referring to FIG. 1 and FIG. 2, disclosed here is an electrical connector made in accordance with the present invention. The electrical connector includes an insulative housing 1, a tongue member 2 retained to the housing 1, a shielding shell 3 surrounding the housing 1 and a spacer 4 disposed at a bottom portion of the housing 1.

Figure 3:
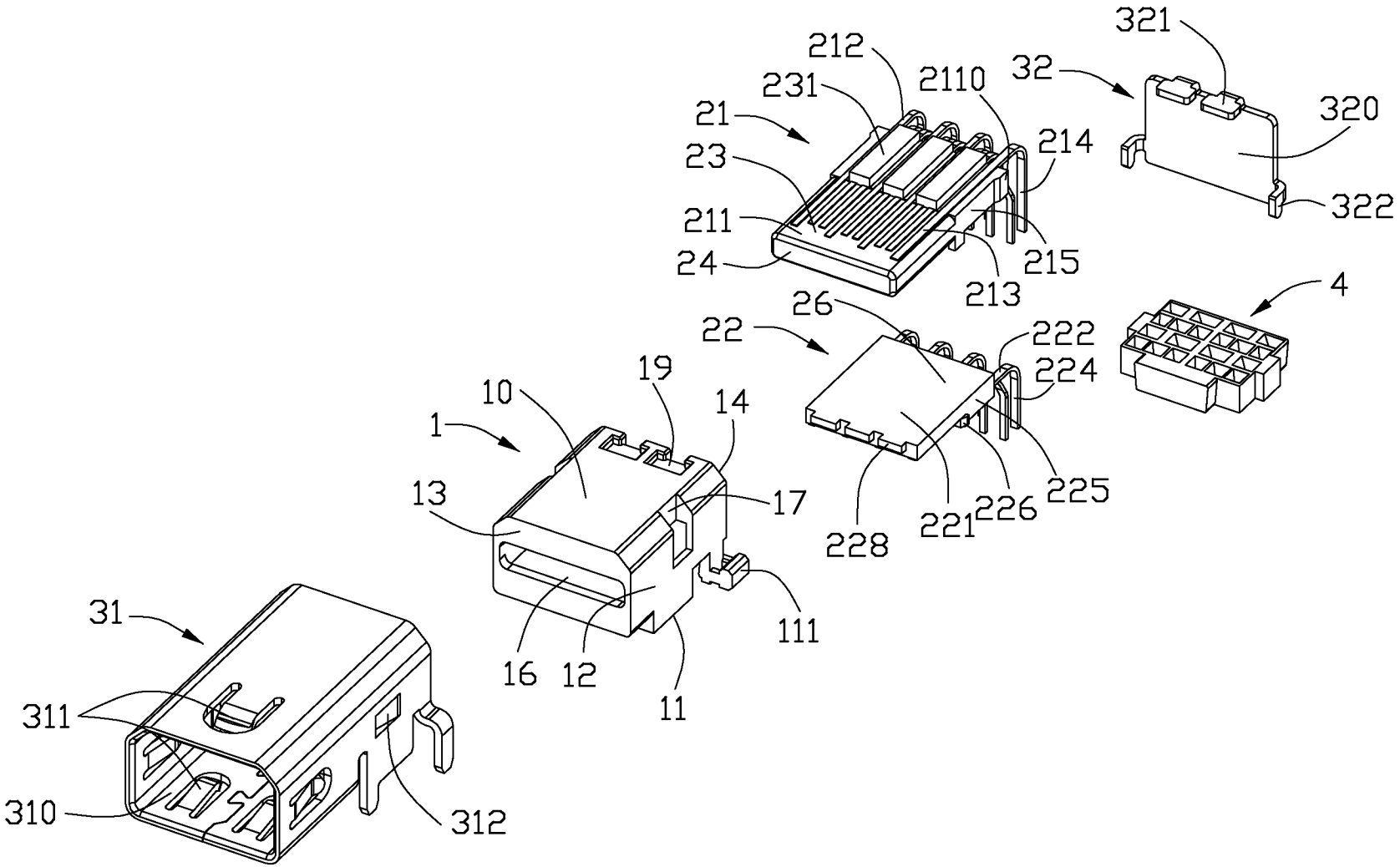
FIG. 3 is an exploded perspective view of the electrical connector shown in FIG. 1.
Figure 4:
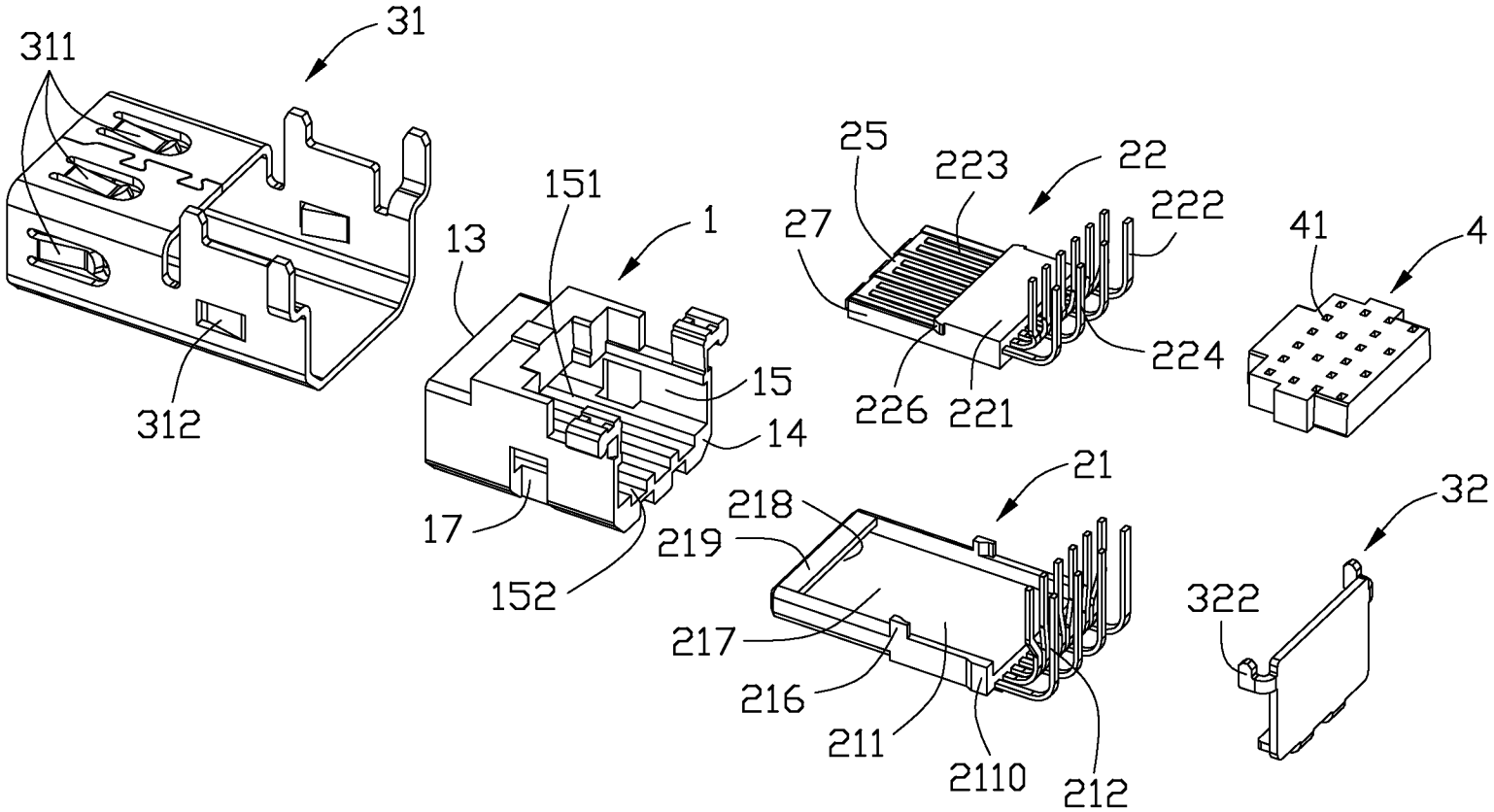
FIG. 4 is another exploded perspective view of the electrical connector shown in FIG. 3.

Referring to FIG. 3 and FIG. 4, the housing 1 defines a top wall 10, a bottom wall 11 opposite to the top wall 10, a pair of opposite side faces 12 connecting with the top wall 10, a front wall having a front face 13 connecting with the top wall 10 and the side faces 12, and a rear face 14 opposite to the front face 13. A receiving cavity 15 is recessed forward from the rear face 14 to run through the front face 13 and provide an opening 16 at the front face 13 thereof, the receiving cavity 15 runs through a rear portion of the bottom wall to provide a receiving portion 151 thereof and further defines three separated receiving slot 152 at an inner face of the top wall 10 thereof. The housing 1 defines a retaining hole 17 recessed from each side face 12 thereof to communicate with the receiving cavity 15.

Referring to FIG. 3 to FIG. 6, the tongue member 2 includes a first tongue module 21 and a second tongue module 22 assembled to the first tongue member 21. The first tongue module 21 defines a first main body portion 211 and a plurality of first contacts 212 insert molded into the first main body portion 211. Each of the first contacts 212 defines a contacting portion 213 exposed onto a top wall 23 of the first main body portion 211 and a connecting portion 214 extending out of the first main body portion 211. The first main body portion 211 defines a front wall 24 connecting with the top wall 23, a pair of sidewalls 215 connecting with the top wall 23 and the front wall 24, and a receiving room 217 defined by the pair of sidewalls 215 and the top wall 23 commonly. The first main body portion 211 further defines a blocking plate 219 connecting with the front wall 24 and the sidewalls 215. The blocking plate 219 is parallel to the top wall 23, and a retaining slot 218 is defined by the top wall 23, the front wall 24, the sidewalls 215 and the blocking plate 219 commonly. The top wall 23 defines three restricting portions 231 projecting upwards from a top face of the top wall 23. Each sidewall 215 defines a cuneal blocking protrusion 216 extending downwardly from a bottom edge thereof, and a retaining protrusion 2110 extending outwards from a side face of the sidewall 215 at a rear portion thereof.

The second tongue module 22 defines a second main body portion 221 and a plurality of second contacts 222 insert molded into the second main body portion 211. The second main body portion 221 defines a base portion 26 and a tongue portion 27 extending forward from the base portion 26. The base portion 26 defines two blocking portions 226 each projecting outwards from a side face 225 at a front portion thereof, and the tongue portion 27 defines three retaining portions 228 projecting forwardly from a front face thereof. Each of the second contacts 222 defines a contacting portion 223 disposed at a bottom face 25 of the tongue portion 27 and a connecting portion 224 extending out of the base portion 26. The second tongue module 22 is firstly inserted into the receiving room 217 of the first tongue module 21 in a vertical direction, and then pushed moving forwardly in the receiving room 217 until the blocking portion 226 sliding over the blocking protrusion 216 and abutted against by the blocking protrusion 216 for preventing the second tongue module 22 from moving backwards. The retaining portions 228 enter into the retaining slot 218 and are supported by the blocking plate 219 for preventing the second tongue module 22 from downwardly moving. The retaining portions 228 are sandwiched by the top wall 23 and the blocking plate 219.

Figure 5:
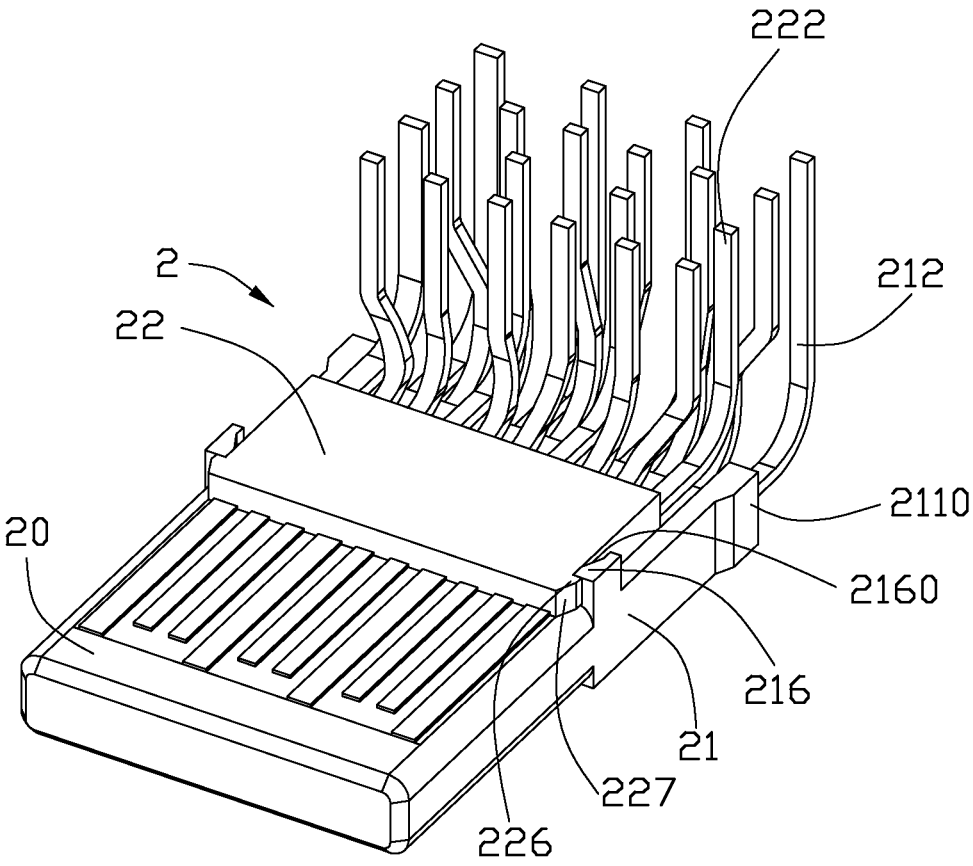
FIG. 5 is an assembled, perspective view of a tongue member in accordance with the present invention.
Figure 6:
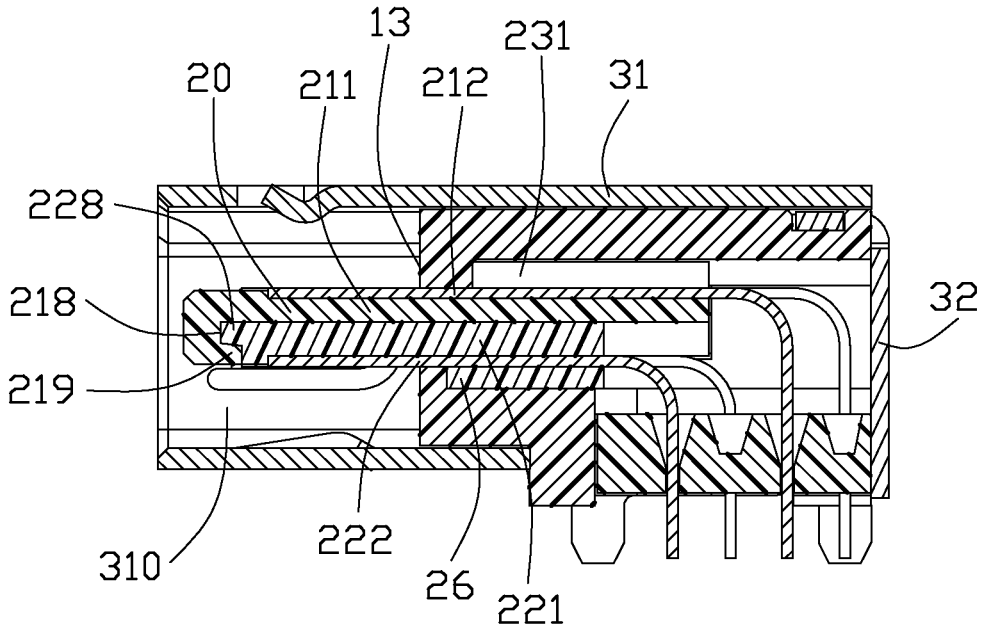
FIG. 6 is a cross sectional view taken along line 6-6 of FIG. 1.

Referring to FIG. 5, the first guiding face 2160 disposed in the blocking protrusion 216 will cooperate with the second guiding face 227 of the blocking portion 226 to make the second tongue module 22 move in the receiving room 217 smoothly. Referring to FIG. 3 to FIG. 5, the first and second tongue modules 21, 22 are assembled securely to provide the tongue member 2, and the tongue member 2 provides a mating portion 20 at a front portion thereof with the contacting portions 213, 223 disposed at opposite faces of the mating portion 20. The tongue member 2 is assembled to the receiving cavity 15 from the rear face 14 thereof with the restricting portions 231 received in the corresponding receiving slots 152, the tongue member 2 moves forwardly in the receiving cavity 15 until the retaining protrusions 2110 projecting into the retaining hole 17 and restricted in the retaining hole 17, and the mating portion 20 runs through the opening 16 and projects beyond the front face 13 of the housing 1. The front wall of the housing 1 abuts against the restricting portions 231 and the base portion 26 to prevent the tongue member 2 from moving forwardly. The spacer 4 is retained to the receiving portion 151 from the bottom wall 11 thereof, and the connecting portions 214, 224 pass through the through holes 41 to connect with other components.

Referring to FIG. 3 to FIG. 5, the metal shell includes a first shell 31 surrounding the housing 1 and a second shell 32 shielding the rear face 14 of the housing 1. The first shell 31 defines four side pieces and a mating cavity 310 defined by the four side pieces commonly. The second shell 32 defines a shielding plate 320, a pair of T-shaped locking parts 321 bending forward from a top edge of the shielding plate 320 and two fixing legs 322 each extending from a side edge of the shielding plate 320. The second shell 32 is retained to the housing 1 by the locking parts 321 locking into the corresponding T-shaped locking slots 19 disposed in the top wall 10 and the fixing legs 322 fixed in the corresponding supporting portions 111 each outwardly extending from the housing 1. The first shell 31 surrounds the housing 1 with the mating portion 20 disposed in the mating cavity 310. The spring arms 311 extending from the side pieces project into the mating cavity 310 to contact with a mating connector. The locking springs 312 lock with the housing 1 to retain the first shell 31 and the housing 1 securely.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing and a shell surrounding the housing to define a receiving cavity;

a tongue member retained to the receiving cavity, and configured by first and second tongue modules interlocked with each other, the first tongue module embedded with a plurality of first contacts thereof and the second tongue module embedded with a plurality of second contacts thereof;

wherein the first tongue module defines a first main body portion having a first mating wall and a first front wall connecting with the first mating wall, the plurality of first contacts define corresponding first contacting portions exposed upon the first mating wall, the second module defines a second main body portion having a second mating wall and a second front wall connecting with the second mating wall, the plurality of second contacts define corresponding second contacting portions exposed upon the second mating wall;

wherein the second front wall of the second tongue module is completely behind the first front wall of the first tongue module and abuts against a rear face of the first front wall, and thereby the first front wall functions as a confrontation wall for a mating connecting.

2. The electrical connector as described in claim 1, wherein the first tongue module defines a retaining slot at a front portion thereof and a blocking plate surrounding the retaining slot, the second tongue module defines at least one retaining portion received in the retaining slot and supported by the blocking plate, the retaining slot is defined by the first wall, the first front wall and the blocking plate commonly.

3. The electrical connector as described in claim 2, wherein the blocking plate is parallel to the first wall, and the at least one retaining portion is sandwiched by the first wall and the blocking plate.

4. The electrical connector as described in claim 3, wherein the first main body portion defines a pair of sidewalls connecting with the first wall, and a receiving room communicating with the retaining slot is defined by the pair of sidewalls and the top first wall commonly.

5. The electrical connector as described in claim 1, wherein the second main body portion is received in the receiving room, and the at least one retaining portion projects into the retaining slot.

6. The electrical connector as described in claim 5, wherein each sidewall of the first main body portion defines a blocking protrusion extending therefrom, and the second main body portion defines corresponding blocking portions forwardly sliding over the blocking protrusions and abutted against by the blocking protrusion.

7. The electrical connector as described in claim 1, wherein the tongue member defines retaining protrusions extending outwards to lock with the housing.

8. The electrical connector as described in claim 7, further defining a spacer disposed at the housing, and the spacer defines through holes for permitting connecting portions of the contacts passing through.

9. The electrical connector as described in claim 7, wherein the shell includes a first shell defining a mating cavity thereof and a second shell shielding a rear face of the housing, the first shell surrounds the housing with a mating portion of the housing disposed in the mating cavity.

10. An electrical connector comprising:

a first main body portion defining a top wall, two sidewalls connecting with the top wall, a receiving room defined by the top wall and the sidewalls commonly, and blocking protrusions each extending downwardly from a bottom portion of the sidewall;

a second main body portion retained in the receiving room, defining blocking portions forwardly sliding over the blocking protrusions and abutted against by the blocking protrusions; and contacts at least retained in the second main body portion; wherein the receiving room further extends forwardly to provide a retaining slot surrounded at least by the top wall and a blocking plate facing to the top wall at a front portion of the first main body portion, and the second main body portion defines at least one retaining portion received in the retaining slot and supported by the blocking plate.

11. The electrical connector as described in claim 10, wherein the at least one retaining portion is sandwiched by the top wall and the blocking plate.

12. The electrical connector as described in claim 11, wherein the first main body portion defines a front wall connecting with the top wall and the blocking plate, and the retaining slot is surrounded by the top wall, the front wall and the blocking plate.

13. The electrical connector as described in claim 10, wherein the blocking protrusions each defines a first guiding face, and the blocking portions each defines a second guiding cooperating with the first guiding face.

14. The electrical connector as described in claim 13, further defining an insulative housing for retaining the first and second main body portions, and the first main body portion defines retaining protrusions extending outwards from the sidewalls to lock with the housing.

15. An electrical connector comprising:

an insulative housing defining a receiving cavity with an opening forwardly communicating with an exterior;

an upper terminal module associated with embedded upper contacts with corresponding contact sections exposed upon an upper mating face thereon and equipped with an upper block behind the upper mating face;

a lower terminal module associated with embedded lower contacts with corresponding contact portions exposed upon a lower mating face thereon and equipped with a lower block behind the lower mating face;

said upper terminal module and said lower terminal module being stacked with each other in a vertical direction via confrontation between the a lower face of the upper terminal module and an upper face of the lower terminal module; wherein front portions of the stacked upper terminal module and lower terminal module commonly extend through the opening to be exposed in front of the housing and expose the corresponding upper mating face and lower mating face under condition that at least one the upper block and the lower block forwardly abuts against the housing for preventing forward movement of the stacked upper terminal module and lower terminal module from forwardly moving.

16. The electrical connector as claimed in claim 15, wherein one of the lower face of the upper terminal module and the upper face of the lower terminal module defines a recess to receive the other so as to said stacked upper terminal module and said lower terminal module partially overlapped with each other in a front-to-back direction perpendicular to said vertical direction.

17. The electrical connector as claimed in claim 16, wherein said recess is formed in the lower face of the upper terminal module.

18. The electrical connector as claimed in claim 17, wherein a periphery of said lower terminal module is essentially fully received in the recess.

19. The electrical connector as claimed in claim 18, wherein a metallic shell encloses sad housing including the front portions of the stacked upper terminal module and lower terminal module.

20. The electrical connector as claimed in claim 15, wherein one of the front portions of the upper terminal module and the lower terminal module defines an elongated retaining slot which essentially extends with a full dimension of said one of the upper terminal module and the lower terminal module in a transverse direction, and the other of the front portions of the upper terminal module and the lower terminal module defines a retaining portion protectively hidden in the retaining slot, and wherein the front portion of said other of the upper terminal module and the lower terminal module is fully protectively located behind the front portion of said one of the upper terminal module and the lower terminal module.

* * * * *